US008146349B2

(12) United States Patent
Bloms et al.

(10) Patent No.: US 8,146,349 B2
(45) Date of Patent: Apr. 3, 2012

(54) EXHAUST SYSTEM IMPLEMENTING TEMPERATURE-CONSTRAINING REGENERATION STRATEGY

(75) Inventors: Jason K. Bloms, Peoria, IL (US); Tyler V. Richards, Peoria, IL (US)

(73) Assignee: Caterpiller Inc., Peoria, IL (US)

( * ) Notice: Subject to any disclaimer, the term of this patent is extended or adjusted under 35 U.S.C. 154(b) by 893 days.

(21) Appl. No.: 12/078,414

(22) Filed: Mar. 31, 2008

(65) Prior Publication Data

US 2009/0241517 A1 Oct. 1, 2009

(51) Int. Cl.
*F01N 3/00* (2006.01)

(52) U.S. Cl. ..... 60/295; 60/297

(58) Field of Classification Search ..... 60/274, 60/286, 295, 297, 300, 303, 311
See application file for complete search history.

(56) References Cited

U.S. PATENT DOCUMENTS 5,277,025 A * 1/1994 Gonze et al. ..... 60/274
6,722,120 B2 * 4/2004 Plote ..... 60/276
6,851,258 B2 * 2/2005 Kawashima et al. ..... 60/311
7,246,485 B2 * 7/2007 Ohki et al. ..... 60/285
2006/0096280 A1 * 5/2006 Zhan et al. ..... 60/297
2006/0254261 A1 * 11/2006 Ishihara ..... 60/295
2007/0000241 A1 1/2007 Funke et al.

* cited by examiner

*Primary Examiner* — Thomas Denion
*Assistant Examiner* — Patrick Maines
(74) *Attorney, Agent, or Firm* — Finnegan, Henderson, Farabow, Garrett & Dunner LLP

(57) ABSTRACT

An exhaust system for use with a combustion engine is disclosed. The exhaust system may have an exhaust passage, a particulate filter located within the exhaust passage, and a heating device located to selectively heat matter collected within the particulate filter. The exhaust system may also have a controller configured to determine an amount of matter collected within the particulate filter exceeding a threshold amount, and to activate the heating device in a first operating mode to regenerate the particulate filter based on the amount of collected matter. The controller may be further configured to detect a temperature constraining condition of the combustion engine, to determine an amount of oxygen within the flow of exhaust during the temperature constraining condition, and to activate the heating device in a second operating mode to constrain a regeneration temperature of the particulate filter based on the amount of oxygen within the flow of exhaust.

19 Claims, 2 Drawing Sheets

EXHAUST SYSTEM IMPLEMENTING TEMPERATURE-CONSTRAINING REGENERATION STRATEGY

TECHNICAL FIELD

The present disclosure relates generally to an exhaust system and, more particularly, to an exhaust system that implements a temperature-constraining regeneration strategy.

BACKGROUND

Particulate filters are utilized to remove particulate matter from an engine's exhaust flow. After an extended period of use, however, the particulate filter can become saturated with particulate matter, thereby reducing the functionality of the filter and subsequent engine performance. The collected particulate matter can be removed from the particulate filter through a process called active regeneration. Active regeneration is the burning away of trapped particulate matter at high temperatures, typically in excess of 600° C. These temperatures can be periodically achieved through engine control, electric grids, and fuel-fired burners located upstream of the filter to heat the exhaust flowing through the filter.

When a machine is stationary, active regeneration may be undesirable in certain circumstances, as it can heat the exhaust system too high for the immediate environment. For example, if the machine was to stop and remain stationary in or near a location of dry debris, it might be possible for the high regeneration temperatures of the exhaust system to ignite the debris. Thus, when the machine is parked or moving very slowly in these areas for extended periods of time, active regeneration is generally disabled and/or prohibited.

An exemplary system that selectively disables active regeneration is disclosed by U.S. Patent Publication No. 2007/0000241 (the '241 publication) by Funke et al., published Jan. 4, 2007. The '241 publication discloses a particulate trap system for use with a mobile machine. The particulate trap system has a particulate trap, a regeneration device, and a controller. The controller is configured to control the regeneration device based on input received from different sensors. For example, when regeneration of the particulate trap is required and the mobile machine is traveling at a speed greater than three miles per hour, the controller directs the regeneration device to elevate the temperature of the particulate trap to thereby burn away trapped matter. In contrast, when the machine's travel speed is less than three miles per hour, regeneration is completely disabled. The controller can similarly control the regeneration device based on an exhaust temperature, a selected gear ratio of an associated transmission (i.e., based on if the transmission is in neutral), and/or the activation of a parking brake. In this manner, regeneration can be halted or inhibited when the machine is substantially stationary.

Unfortunately, when active regeneration is completely disabled, subsequent regeneration events may be undesirably extended. That is, by completely disabling active regeneration, if even for only a short period of time, it may take a long period of time and a large amount of energy to re-elevate the exhaust to the regeneration temperature range experienced prior to the disabling. And, if the disabling is implemented frequently, as may be the case in stop-and-go applications, for example in vocational application such as waste management (garbage truck) and public transportation (bus) or in recreational applications (RVs), the time between disabling events may be too short for the exhaust temperatures to be raised to a level sufficient for complete regeneration of the particulate filter. When complete regeneration is not possible, it may be required to continuously attempt regeneration, which may result in further efficiency losses.

The disclosed exhaust system is directed toward overcoming one or more of the problems set forth above and/or other problems in the art.

SUMMARY OF THE INVENTION

One aspect of the present disclosure is directed to an exhaust system for use with a combustion engine. The exhaust system may include an exhaust passage configured to receive a flow of exhaust from the combustion engine, a particulate filter located within the exhaust passage and configured to collect matter from the flow of exhaust, and a heating device located to selectively heat the matter collected within the particulate filter. The exhaust system may also include a controller in communication with the combustion engine and the heating device. The controller may be configured to determine an amount of matter collected within the particulate filter exceeding a threshold amount, and to activate the heating device in a first operating mode to regenerate the particulate filter based on the amount of collected matter. The controller may be further configured to detect a temperature constraining condition of the combustion engine, to determine an amount of oxygen within the flow of exhaust during the temperature constraining condition, and to activate the heating device in a second operating mode to constrain a regeneration temperature of the particulate filter based on the amount of oxygen within the flow of exhaust.

Another aspect of the present disclosure is directed to a method of treating exhaust from a combustion engine. The method may include collecting particulate matter from the exhaust, determining an amount of collected particulate matter exceeding a threshold amount, and heating the particulate matter based on the amount of collected particulate matter during a first mode of operation. The method may further include detecting a temperature constraining condition of the combustion engine, determining an amount of oxygen within the exhaust during the temperature constraining condition, and constraining an amount energy added to the exhaust during a second mode of operation based on the amount of oxygen within the exhaust.

DETAILED DESCRIPTION

Figure 1:
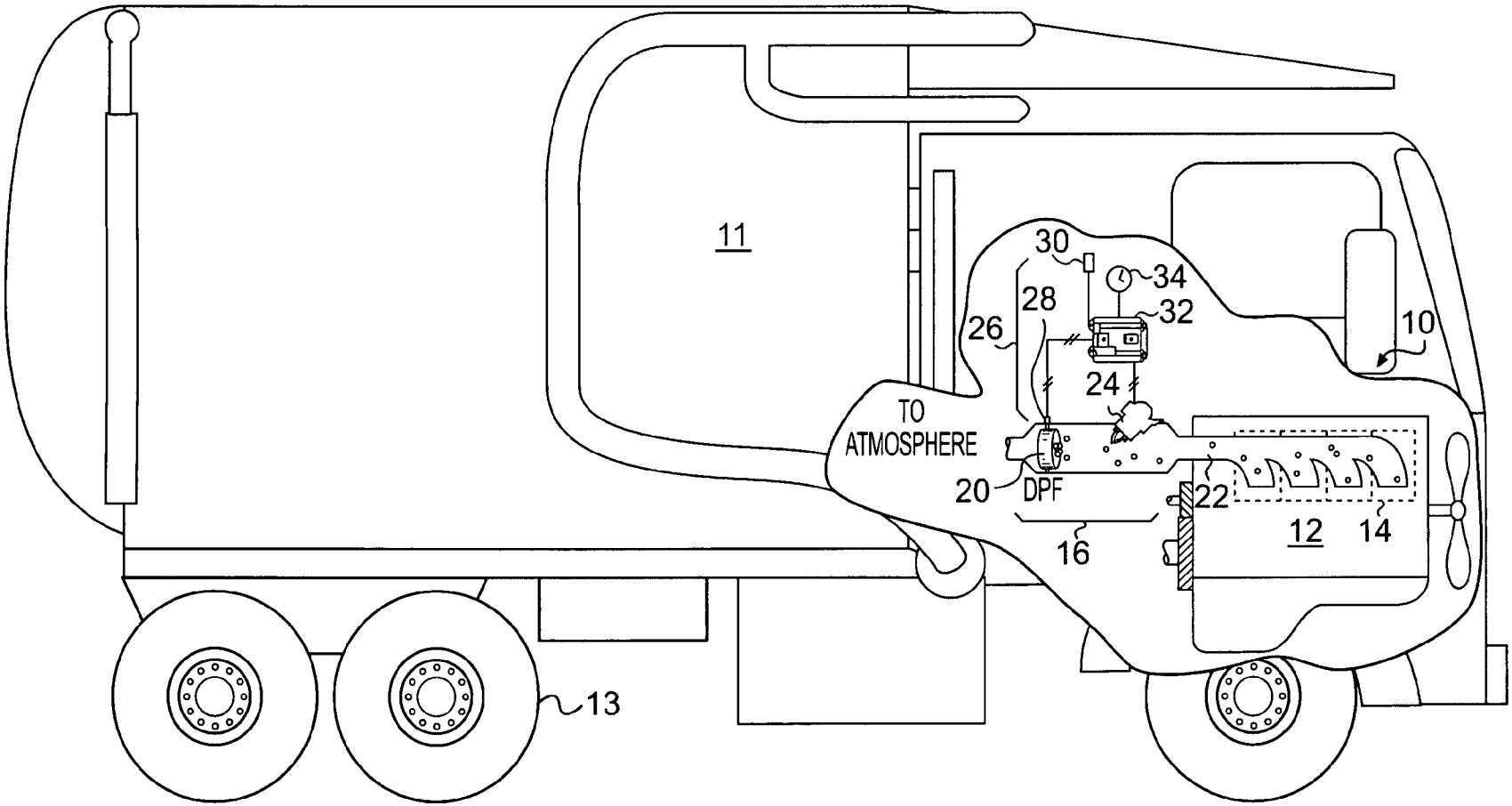
FIG. 1 is a diagrammatic illustration of an exemplary disclosed power system.

FIG. 1 illustrates an exemplary power system 10. Power system 10 may be associated with a mobile machine 11 so as to propel the machine by way of one or more traction devices 13 and a transmission system (not shown). Although illustrated for use in a waste management application (e.g., for use as the prime mover of a garbage truck), power system 10 may also be used in conjunction with other stop-and-go mobile applications such as public transportation (e.g., city or school bus), product delivery (e.g., mail or package delivery truck), or recreational use (e.g., RVs). In these applications, mobile machine 11 may move for relatively short durations between stops. In one example, mobile machine may drive for only about 20 seconds before stopping, and then remain stopped for about 20 seconds.

For the purposes of this disclosure, power system 10 is depicted and described as a diesel-fueled, internal combustion engine. It is contemplated, however, that power system 10 may embody any other type of combustion engine such as, for example, a gasoline or a gaseous fuel-powered engine. Power system 10 may include an engine block 12 that at least partially defines a plurality of cylinders 14. It is contemplated that power system 10 may include any number of cylinders 14 and that cylinders 14 may be disposed in an "in-line" configuration, a "V" configuration, or any other conventional configuration.

An exhaust system 16 may be associated with power system 10, and include components that condition and direct exhaust from cylinders 14 to the atmosphere. For example, exhaust system 16 may include a treatment device 20 disposed within an exhaust passage 22. A heating device 24 may be located upstream of treatment device 20 to warm treatment device 20. It is contemplated that exhaust system 16 may include different or additional components than described above such as, for example, energy extraction devices, bypass components, braking devices, attenuation devices, additional treatment devices, and other known components, if desired.

Treatment device 20 may receive exhaust from passage 22, and remove and collect constituents from the exhaust. In one example, treatment device 20 may embody a particulate filter. As a particulate filter, treatment device 20 may be designed to trap or collect particulate matter, and may include a wire mesh or ceramic honeycomb filtration medium. As the exhaust passes through the medium, solid particulates entrained within the exhaust may impinge against the medium and be blocked from passing through to the atmosphere. After a period of operation, the particulate matter may build up within the medium. And, if unaccounted for, this buildup of matter could reduce the functionality of the filter and subsequent engine performance.

Heating device 24 may be situated to selectively promote regeneration of treatment device 20 (i.e., to promote the burning away of the collected particulate matter). Heating device 24 may embody, for example, a fuel-fired burner, an electric grid, or other similar device known in the art that is configured to selectively heat the exhaust flowing through treatment device 20 and, thereby, indirectly heat the particulate matter trapped within treatment device 20. Alternatively, heating device 24 could be situated to directly heat treatment device 20 and/or the trapped particulate matter, if desired. As the heated exhaust flows through treatment device 20, a suitable regeneration temperature may be attained, and a desired amount of particulate matter collected therein may undergo an exothermic reaction and be reduced. This process may be know as active regeneration, as the temperature of the exhaust may be artificially raised by heating device 24 to a level that burns off particulate matter with or without the use of a catalyst.

A control system 26 may be associated with power system 10 and include components that cooperate to regulate the temperature of exhaust and/or particulate matter within treatment device 20 in order to facilitate active regeneration. Specifically, control system 26 may include a first sensor 28 configured to determine a soot loading of treatment device 20, a second sensor 30 configured to determine an operational condition of machine 11, and a controller 32 in communication with sensors 28, 30 and with heating deice 24. Controller 32 may be configured to regulate operation of heating device 24 in response to input received from sensors 28, 30.

First sensor 28 may embody any type of sensor utilized to determine an amount of particulate matter buildup within second treatment device 20. For example, first sensor 28 may embody a pressure sensor or a pair of pressure sensors, a temperature sensor, a model driven virtual sensor, an RF sensor, or a combination of these or other known sensors. First sensor 28 may generate a signal directed to controller 32 indicative of the particulate matter buildup within treatment device 20.

Second sensor 30 may embody any type of sensor configured to monitor an operational condition of machine 11. In one example, second sensor 30 may be a travel speed sensor associated with power system 10, traction device 13, and/or the transmission (not shown). As such, second sensor 30 may generate a signal indicative of a travel speed of machine, and direct this signal to controller 32. When the signal indicates a travel speed lower than a threshold speed, for example less than about 5 mph, machine 11 (and subsequently power system 10) may be considered to be operating in a temperature constraining condition. The temperature constraining condition may be considered a condition during which exhaust temperatures, and more specifically regeneration exhaust temperatures, should be constrained to minimize the likelihood of undesirable environmental interactions. In one example, the resulting regeneration temperatures achieved during the temperature constraining condition may be substantially the same as the regeneration temperature achieved during a normal operating condition. However, if unaccounted for, the amount of oxygen present during the temperature constraining condition (i.e., when machine 11 is traveling at speeds less than about 5 mph) could result in an uncontrolled exothermic reaction that produces excessive temperatures. It is contemplated that another type of sensor may alternatively be utilized to provide an indication of operation in the temperature constraining condition, if desired.

Controller 32 may embody a single microprocessor or multiple microprocessors that include a means for controlling an operation of heating device 24 in response to signals received from sensors 28, 30. Numerous commercially available microprocessors can be configured to perform the functions of controller 32. It should be appreciated that controller 32 could readily embody a general power system or machine microprocessor capable of controlling numerous power system and/or machine functions and modes of operation. Various other known circuits may be associated with controller 32, including power supply circuitry, signal-conditioning circuitry, solenoid driver circuitry, communication circuitry, and other appropriate circuitry.

In one embodiment, a timer 34 may be also associated with controller 32. In response to a command from controller 32, timer 34 may track an elapsed time. Signals indicative of this elapsed time may be directed from timer 34 to controller 32.

Figure 2:
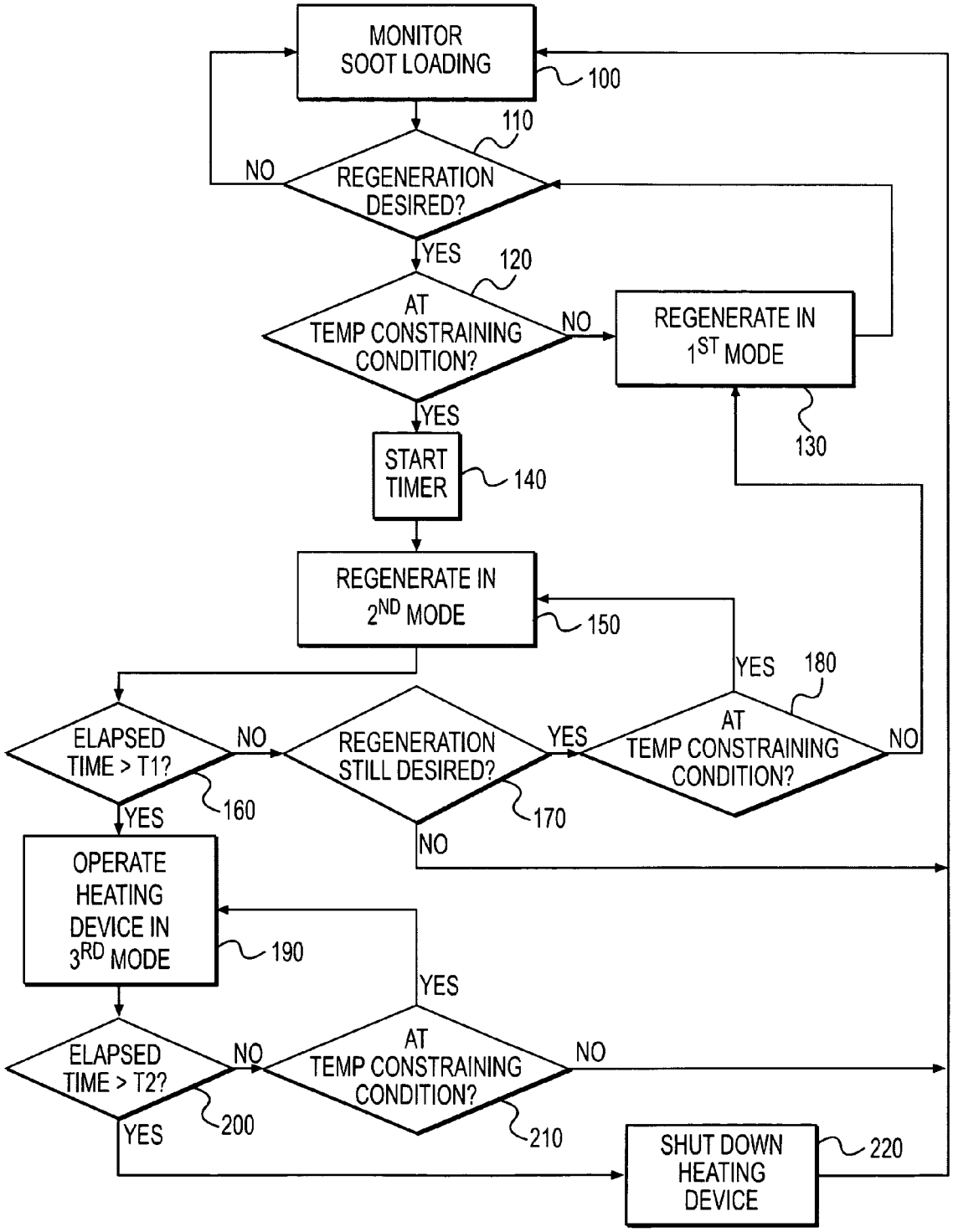
FIG. 2 is a flowchart of an exemplary disclosed method performed by the power system of FIG. 1.

FIG. 2 illustrates an exemplary method performed by controller 32. FIG. 2 will be discussed in more detail in the following section to further illustrate the disclosed concepts.

Industrial Applicability

The disclosed exhaust system may be applicable to any machine system where pollution control and efficiency during stop-and-go operations is important. The disclosed system may provide for continued particulate reduction during stop-and-go operations, by executing a temperature constraining regeneration strategy when the machine is stopped or moving at slow speeds. In addition, the temperature constraining regeneration strategy may improve regeneration efficiency and shorten the duration of a non-constrained regeneration event performed during subsequent travel of the machine, by maintaining a sufficient level of heat in the exhaust system. This temperature constraining regeneration strategy will now be described.

As shown in FIG. 2, the strategy may begin at startup of power system 10 with the monitoring of soot loading within treatment device 20 (i.e., by the monitoring of the buildup of particulate matter within treatment device 10) by first sensor 30 (Step 100). As described above, during normal operating conditions (when the travel speed of machine 10 exceeds about 5 mph), controller 32 may compare the soot loading of treatment device 20 to a threshold value to determine if regeneration is desired or necessary (Step 110). If the soot loading of treatment device 20 is below the threshold value, regeneration may be undesired and control may return to step 100.

However, when the signal from second sensor 30 indicates the soot loading of treatment device 20 is approaching or has surpassed the threshold value, controller 32 may then determine if power system 10 is operating in the temperature constraining condition (i.e., if the travel speed of machine 10 is less than about 5 mph) (Step 120). If power system 10 is not operating in the temperature constraining condition (i.e., if power system 10 is operating in the normal condition and machine 11 is traveling at speeds greater than 5 mph) and the soot loading of second treatment device 20 has exceeded the threshold value, controller 32 may initiate active regeneration in a first mode of operation (Step 130). That is, controller 32 may control heating device 24 to elevate the temperature of the exhaust passing through treatment device 20 to a combustion threshold of the particulate matter such that substantially all of the particulate matter trapped therein is burned away. In one example, the combustion threshold may be fixed (e.g., about 600° C.) and based on a fully loaded particulate filter and a limited amount of oxygen available in the exhaust flow from power system 10. In this example, heating device 24 may maintain the temperature of the exhaust above the fixed threshold for a fixed period of time. In one example, the fixed period of time may be in the range of about 15 min-1 hr. The fixed threshold and period of time may vary according to application and be determined through lab and/or field testing. Because active regeneration may be implemented during a normal temperature condition, little energy may be required of heating device 24 to sufficiently elevate the exhaust temperatures. Control may loop through steps 100-130 until either the amount of particulate matter remaining with treatment device 20 is reduced below a threshold amount and regeneration is no longer desired, or until the status of power system 10 changes to the temperature constraining condition.

If power system 10 is operating in the temperature constraining condition and the soot loading of treatment device 20 has exceeded the threshold value, controller 32 may command timer 34 to begin tracking time (Step 140). After or at about the same time as performing step 140, controller 32 may adjust the operational mode of heating device 24. Specifically, controller 32 may cause heating device 24 to operate in a second mode (Step 150). In the second mode of operation, controller 32 may determine an amount of $O_2$ present in the exhaust from power system 10, and regulate an amount of energy added to the exhaust by heating device 24 (e.g., an amount of fuel injected into the exhaust and combusted by heating device 24) based on the concentration of $O_2$ present such that a desired air-to-fuel ratio of the combustion mixture is achieved. When ignited, the resulting air/fuel mixture having the desired ratio, together with the combusting particulate matter, may achieve an exhaust temperature that is equal to or lower than a maximum acceptable temperature of exhaust system 16.

Controller 32 may be configured to estimate the amount of oxygen present within the exhaust of power system 10. Specifically, controller 32 may include a virtual model used to estimate the amount of oxygen (i.e., quantity, relative percent, ratio, etc.) present based on one or more known or sensed operational parameters of power system 10. For example, based on a known operating speed, load, inlet temperature, boost pressure, and/or other parameter of power system 10, controller 32 may reference the virtual model to determine the $O_2$ concentration of the exhaust entering treatment device 20. Alternatively, a physical sensor (not shown) may be used to generate a signal indicative of the presence of $O_2$, if desired.

During operation of heating device 24 in the second mode, controller 32 may monitor the signals from timer 34 to determine if the time elapsed since initiation of step 140 (i.e., since determination that power system 10 is operating in the temperature constraining condition and is in need of regeneration) has exceeded a first threshold duration T1 (Step 160). In one example, T1 may be about equal to one minute. If the time elapsed since initiation of step 140 is less than T1, controller 32 may check to see if regeneration is still desired (Step 170). Similar to step 110, controller 32 may determine if regeneration is still desired by monitoring the signals from first sensor 28 and comparing the soot loading of heating device 20 to a threshold value.

If regeneration is no longer desired, control may return to step 100. However, if regeneration is still desired, controller 32 may determine if power system 10 is still operating in the temperature constraining condition (Step 180). Similar to step 120, controller 32 may determine if power system 10 is still operating in the temperature constraining condition by monitoring signals from second sensor 30 an comparing the travel speed of machine 11 to a the minimum acceptable travel speed of 5 mph. If power system 10 is no longer operating in the temperature constraining condition and regeneration is still desired, control may return to step 130 where regeneration occurs in the first mode of operation. However, if power system 10 is still operating in the temperature constraining condition and regeneration is still desired, control may instead return to step 150 and continue to cycle through steps 150-180 until the time elapsed since initiation of step 140 exceeds T1, regeneration is no longer desired, or power system 10 is no longer operating in the temperature constraining condition.

Once the time elapsed since initiation of step 140 exceeds T1, controller 32 may cause heating device 24 to operate in a third or pilot mode (Step 190). In the third mode of operation, heating device 24 may be configured to minimally elevate the temperature of the exhaust entering treatment device 20. In contrast, heating device 24 may only add enough energy to the exhaust (i.e., only inject enough fuel) to maintain a pilot flame during the third mode of operation when power source 10 is experiencing the temperature constraining condition. By maintaining the pilot flame, a subsequent regeneration event may be completed in a shorter amount of time and at a higher efficiency level. After initiating step 190, controller 32 may monitor the signals from timer 34 and compare the elapsed time since initiation of step 190 to a second threshold duration T2 (Step 200). In one example, T2 may be about equal to two minutes. If the time elapsed since initiation of step 190 is less than T2, controller 32 may again check to see if power source 10 is still operating in the temperature constraining condition (Step 210). If the time elapsed since initiation of step 190 is less than T2 and power source operation is no longer operating in the temperature constraining condition, control may return to step 100. However, if the time elapsed since initiation of step 190 is less than T2 and power source 10 is still operating in the temperature constraining condition, control may return to step 190 and continue to cycle through steps 190-210 until either the elapsed time exceeds T2 or power source 10 is no longer operating in the temperature constraining condition.

If, at step 200, controller 32 determines that the time elapsed since initiation of step 190 exceeds T2, controller 32 may conclude that the temperature constraining condition will be an extended condition and completely shut down heating device 24. Controller 32 may shut down heating device 24 by inhibiting the addition of energy (i.e., by inhibiting the injection of fuel) into the exhaust from power system 10. In this manner, the exhaust temperatures may be reduced even further, and fuel efficiency may be improved. After shut down of heating device 24, control may return to step 100.

By slowly reducing the amount of energy added to the exhaust from power system 10 by heating device 24 during the temperature constraining condition, regeneration events during subsequent non-temperature constraining conditions may have reduced durations and improved efficiency. Specifically, by maintaining auxiliary heat within the exhaust for an extended period of time (i.e., for the three minute duration of the first and second modes), less energy may be required to fully heat the exhaust to the combustion threshold of the particulate matter during the subsequent regeneration event. And, the time required to heat the exhaust to the combustion threshold during the subsequent regeneration event may be reduced. In one exemplary application, the time required for full regeneration may be reduced by as much as 80%.

It will be apparent to those skilled in the art that various modifications and variations can be made to the disclosed exhaust system without departing from the scope of the disclosure. Other embodiments of the exhaust system will be apparent to those skilled in the art from consideration of the specification and practice of the exhaust system disclosed herein. It is intended that the specification and examples be considered as exemplary only, with a true scope of the disclosure being indicated by the following claims and their equivalents.

What is claimed is:

1. An exhaust system for use with a combustion engine, comprising:
- an exhaust passage configured to receive a flow of exhaust from the combustion engine;
- a particulate filter located within the exhaust passage and configured to collect matter from the flow of exhaust;
- a heating device located to selectively heat the matter collected within the particulate filter; and
- a controller in communication with the combustion engine and the heating device, the controller being configured to:
  - determine an amount of matter collected within the particulate filter exceeding a threshold amount;
  - activate the heating device in a first operating mode to regenerate the particulate filter based on the amount of collected matter and a determination that the combustion engine is operating outside of a temperature constraining condition;
- activate the heating device in a second operating mode based on the amount of collected matter and a determination that the combustion engine is operating in the temperature constraining condition;
- determine an amount of oxygen within the flow of exhaust during the second operating mode; and
- regulate an amount of energy added to the flow of exhaust by the heating device based on the determined amount of oxygen.

2. The exhaust system of claim 1, wherein the heating device is configured to:
- elevate the temperature of the flow of exhaust above a fixed threshold temperature during the first operating mode; and
- maintain the temperature of the flow of exhaust above the fixed threshold temperature for a fixed period of time during the first operating mode.

3. The exhaust system of claim 2, wherein the heating device is a fuel-fired burner, and the heating device is configured to elevate the temperature of the flow of exhaust by injecting an amount of fuel based on the amount of matter collected within the particulate filter.

4. The exhaust system of claim 3, wherein the heating device is configured to constrain the regeneration temperature during the second operating mode by injecting an amount of fuel into the flow of exhaust based on the amount of oxygen within the flow of exhaust.

5. The exhaust system of claim 1, wherein:
- the combustion engine is the prime mover of a mobile machine;
- the exhaust system further includes a travel speed sensor configured to sense a travel speed of the mobile machine;
- the controller is in communication with the travel speed sensor; and
- the temperature constraining condition is a travel speed of the mobile machine being less than a threshold speed.

6. The exhaust system of claim 1, wherein the controller is further configured to activate the heating device in a third operating mode after a fixed duration of operation in the second operating mode has elapsed.

7. The exhaust system of claim 6, wherein the fixed duration of operation in the second operating mode is about one minute.

8. The exhaust system of claim 6, wherein the third operating mode is a pilot mode configured to maintain a flame within the heating device.

9. The exhaust system of claim 6, wherein the controller is further configured to inhibit operation of the heating device after a fixed duration of operation in the third operating mode has elapsed.

10. The exhaust system of claim 9, wherein the fixed duration of operation in the third operating mode is about two minutes.

11. The exhaust system of claim 9, wherein the controller is configured to return operation the heating device to the first operating mode when the temperature constraining condition is no longer detected and the amount of matter collected within the particulate filter remains above the threshold amount.

12. A method of treating exhaust from a combustion engine, comprising:
- collecting particulate matter from the exhaust;
- determining an amount of collected particulate matter exceeding a threshold amount;
- activating a heating device to heat the particulate matter during a first mode of operation, wherein activation is based on the amount of collected particulate matter and a determination that the combustion engine is operating outside of a temperature constraining condition, and wherein heating the particular matter during the first mode of operation includes maintaining the temperature of the exhaust above a fixed threshold temperature for a fixed period of time; and
- constraining an amount of energy added to the exhaust during a second mode of operation based on an amount of oxygen within the exhaust.

13. The method of claim 12, wherein heating the particulate matter includes injecting an amount of fuel into the exhaust based on the amount of collected particulate matter.

14. The method of claim 13, wherein constraining the amount of energy added to the exhaust includes limiting a regeneration temperature of the exhaust during the second mode of operation by injecting an amount of fuel into the exhaust based on the amount of oxygen within the flow of exhaust.

15. The method of claim 12, wherein:

the combustion engine is associated with a mobile machine; and the temperature constraining condition is a travel speed of the mobile machine being less than a threshold value.

16. The method of claim 12, further including reducing the temperature of the exhaust during a third mode of operation after a fixed duration of the second mode of operation has elapsed.

17. The method of claim 16, further including inhibiting the heating of exhaust after a fixed duration of the third mode of operation has elapsed.

18. The method of claim 16, further including returning to the first mode of operation when the temperature constraining condition is no longer detected and the amount of collected particulate matter remains above the threshold amount.

19. A mobile machine, comprising:

an engine configured to combust fuel and generate a flow of exhaust;

at least one traction device driven by the engine to propel the mobile machine;

an exhaust passage configured to receive the flow of exhaust from the engine;

a particulate filter located within the exhaust passage to collect particulate matter from the flow of exhaust;

a fuel-fired burner located to selectively warm the collected particulate matter; and a controller in communication with the engine and the fuel-fired burner, the controller being configured to:

determine an amount of particulate matter collected within the particulate filter exceeding a threshold amount;

determine if the mobile machine is operating above a predetermined travel speed;

activate the fuel-fired burner in a first operating mode to regenerate the particulate filter based on the amount of collected particulate matter and a determination that the mobile machine is operating above the predetermined travel speed;

detect a low travel speed condition of the mobile machine;

determine an amount of oxygen within the flow of exhaust during the low travel speed condition;

activate the fuel-fired burner in a second operating mode to constrain a regeneration temperature of the particulate filter based on the amount of oxygen within the flow of exhaust during the low travel speed condition;

activate the fuel-fired burner in a third operating mode after a fixed duration of operation in the second operating mode has elapsed to maintain a flame within the fuel-fired burner; and inhibit operation of the fuel-fired burner after a fixed duration of operation in the third operating mode has elapsed.

* * * * *